US007686065B2

(12) United States Patent
Luczak

(10) Patent No.: US 7,686,065 B2
(45) Date of Patent: Mar. 30, 2010

(54) INVESTMENT CASTING CORE ASSEMBLY

(75) Inventor: Blake J. Luczak, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 680 days.

(21) Appl. No.: 11/434,990

(22) Filed: May 15, 2006

(65) Prior Publication Data

US 2007/0284411 A1 Dec. 13, 2007

(51) Int. Cl.
*B22C 9/04* (2006.01)
*B22C 9/10* (2006.01)

(52) U.S. Cl. ..... 164/35; 164/28; 164/369; 164/516

(58) Field of Classification Search ..... 164/35, 164/516–519, 369, 28
See application file for complete search history.

(56) References Cited

U.S. PATENT DOCUMENTS

| | | | | |
|---|---|---|---|---|
| 6,637,500 | B2 | 10/2003 | Shah et al. | |
| 6,913,064 | B2 * | 7/2005 | Beals et al. | 164/369 |
| 6,929,054 | B2 | 8/2005 | Beals et al. | |
| 7,172,012 | B1 * | 2/2007 | Memmen | 164/45 |
| 7,306,026 | B2 * | 12/2007 | Memmen | 164/516 |
| 2005/0274478 | A1 * | 12/2005 | Verner et al. | 164/45 |

* cited by examiner

*Primary Examiner*—Kuang Lin
(74) *Attorney, Agent, or Firm*—Bachman & LaPointe, P.C.

(57) ABSTRACT

In a method for manufacturing a combination investment casting core, a plurality of cores are each formed by cutting a metallic sheet to define a first portion and a number of separate second portions linked by the first portion. The second portions are bent out of local alignment with the first portion. The first portions of the cores are assembled and secured to each other.

22 Claims, 15 Drawing Sheets

INVESTMENT CASTING CORE ASSEMBLY

BACKGROUND OF THE INVENTION

The invention relates to investment casting. More particularly, it relates to the investment casting of superalloy turbine engine components.

Investment casting is a commonly used technique for forming metallic components having complex geometries, especially hollow components, and is used in the fabrication of superalloy gas turbine engine components. The invention is described in respect to the production of particular superalloy castings, however it is understood that the invention is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. No. 6,637,500 of Shah et al. and U.S. Pat. No. 6,929,054 of Beals et al (the disclosures of which are incorporated by reference herein as if set forth at length) disclose use of ceramic and refractory metal core combinations.

SUMMARY OF THE INVENTION

One aspect of the invention involves a method for manufacturing a combination investment casting core. A plurality of cores are each formed by cutting a metallic sheet to define a first portion and a number of separate second portions linked by the first portion. The second portions are bent out of local alignment with the first portion. The first portions of the cores are assembled and secured to each other.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
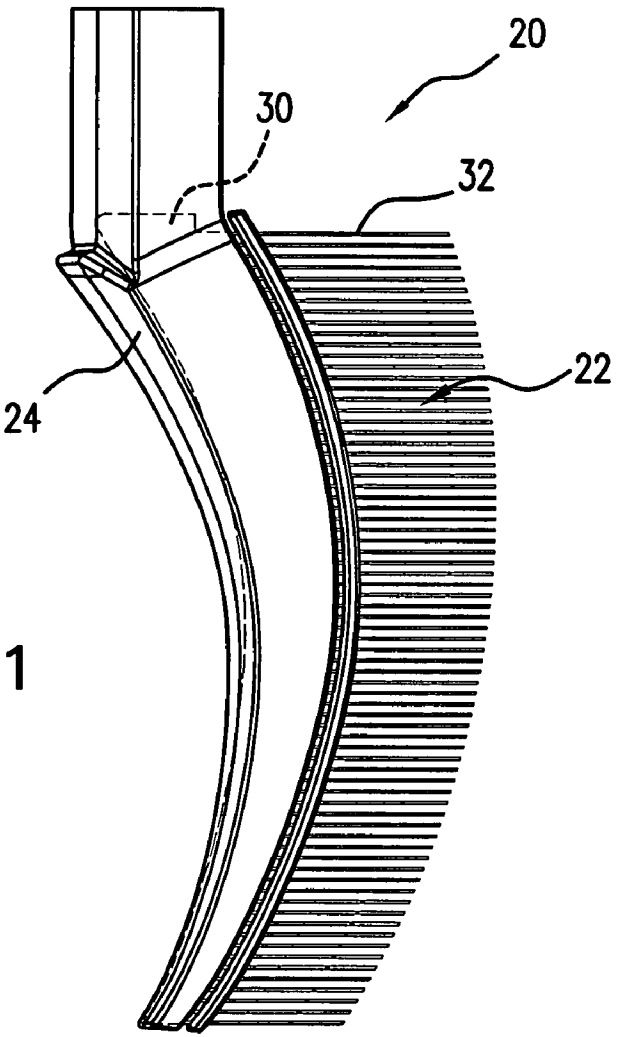
FIG. 1 is a view of a composite casting core.

FIG. 1 shows an exemplary composite casting core 20 comprising a refractory metal core (RMC) assembly 22 secured to a ceramic core 24. The exemplary core 20 is configured for casting an airfoil (e.g., of a blade or vane) wherein the ceramic core 24 casts main feed passageways and RMC assembly 22 forms a comb-like core for casting airfoil trailing edge outlet passageways extending from a trailing one of the feed passageways. The core 20 may include additional cores (e.g., additional RMCs for casting outlet circuits along the leading edge area or the pressure side or suction side walls).

Figure 2:
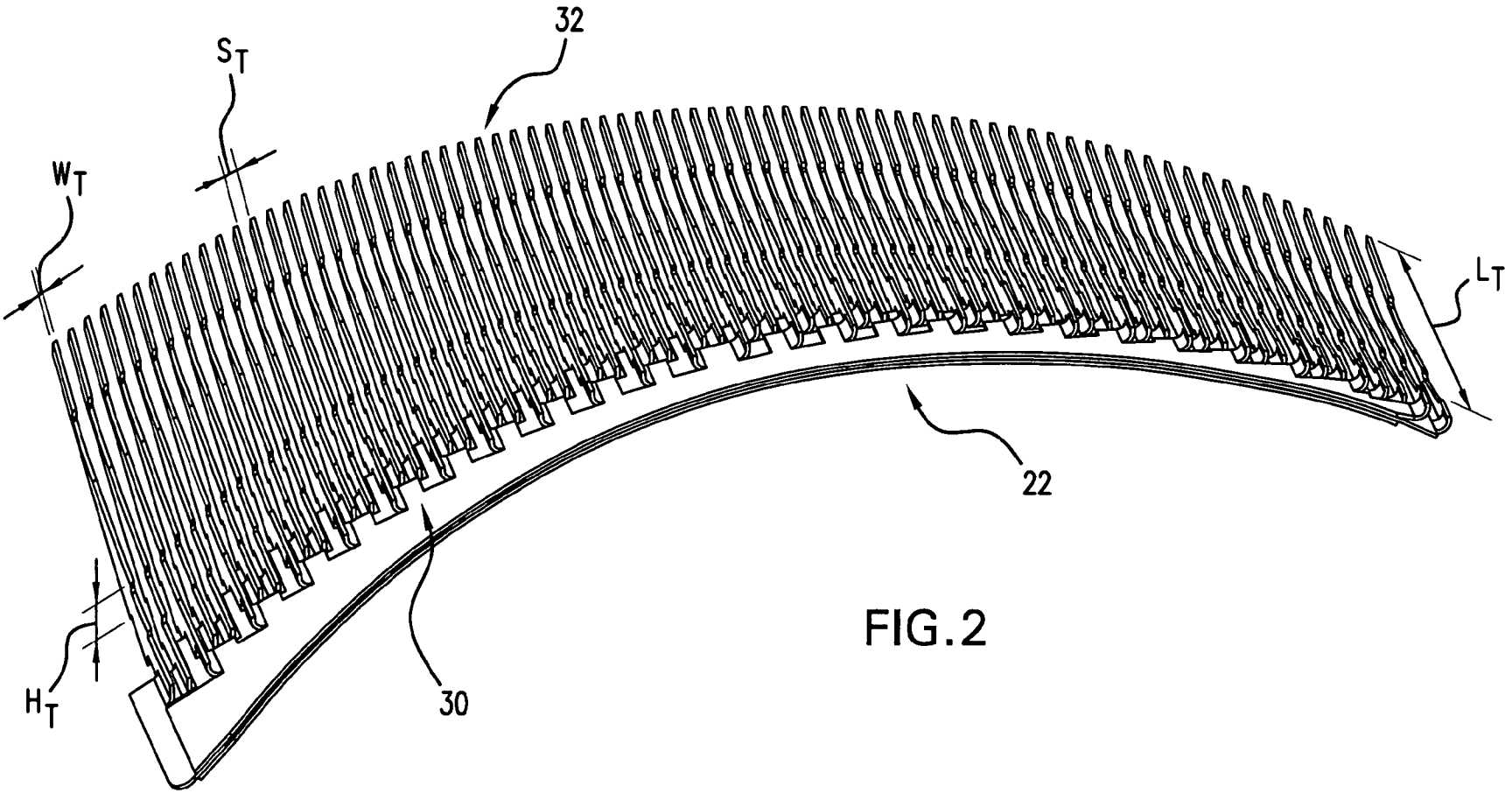
FIG. 2 is a view of a refractory metal core assembly of the core of FIG. 1.

The exemplary RMC assembly comprises a laminated spine 30 secured to the ceramic core 24. A tine array 32 extends from the spine 30. The exemplary tines have a single metallic layer, but some or all might, instead be laminated to increase thickness. FIG. 2 shows the RMC assembly 22 in isolation. Each of the tines has a tine length $L_T$, which may vary tine-to-tine. Each of the tines has a tine height $H_T$, which may vary tine-to-tine. Each of the tines has a tine width $W_T$, which may vary tine-to-tine. An on-center tine spacing along the spine is shown as $S_T$. This may also vary along the tine array.

Figure 3:
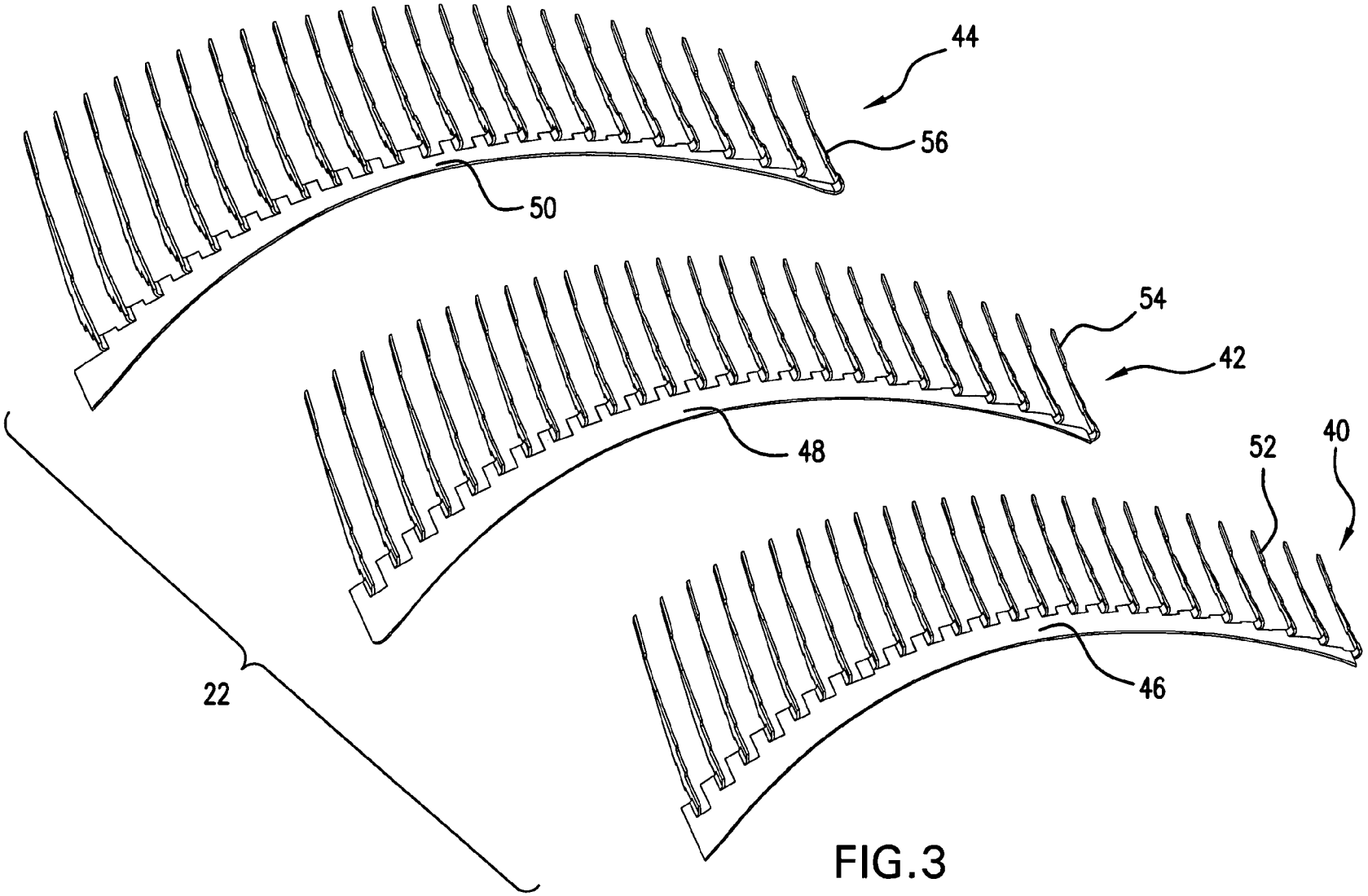
FIG. 3 is an exploded view of the assembly of FIG. 2.

FIG. 3 shows the RMC assembly 22 as formed from the assembly of three individual core elements 40, 42, and 44. Each of the elements 40, 42, and 44 includes a spine 46, 48, and 50 from which extends an associated array of tines 52, 54, and 56, respectively. When the elements 40, 42, and 44 are assembled, their spines 46, 48, and 50 are stacked one atop another and secured to each other while the respective tines are alternatingly interspersed to form the array 32. The assembly of the multiple core elements 40, 42, and 44 permits shape, size, and density (spacing) of the tines otherwise unattainable via similar manufacturing techniques. Each of the core elements 40, 42, and 44 may be manufactured by a similar process.

Figure 4:
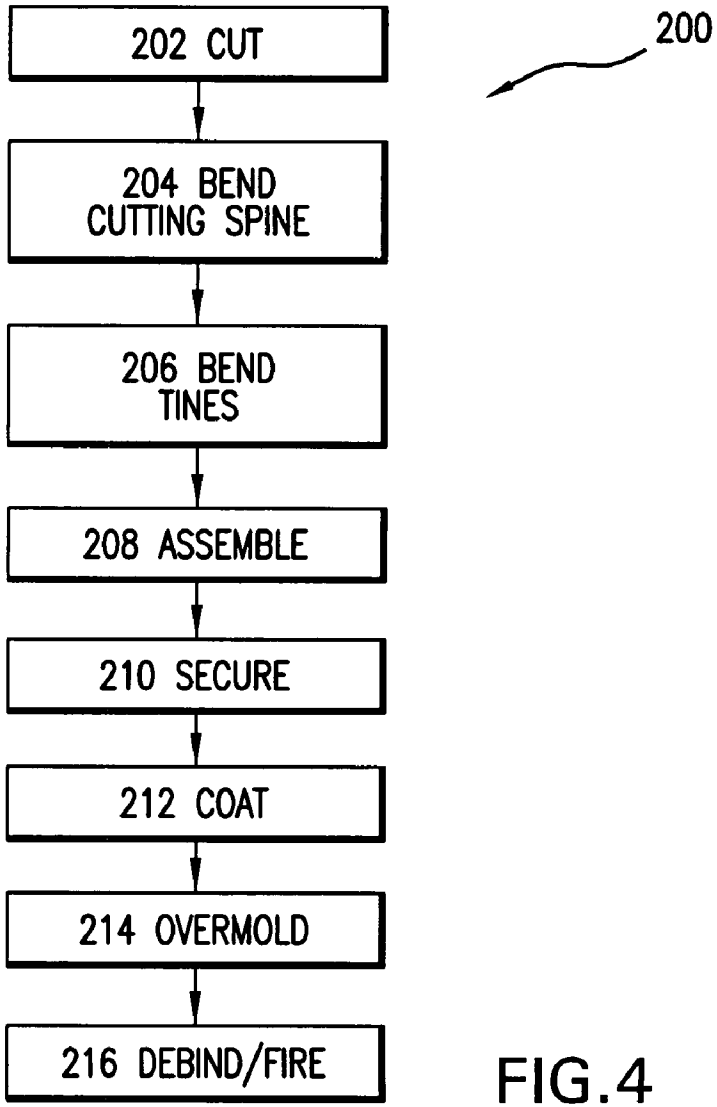
FIG. 4 is a flowchart of a core assembly process.
Figure 5:
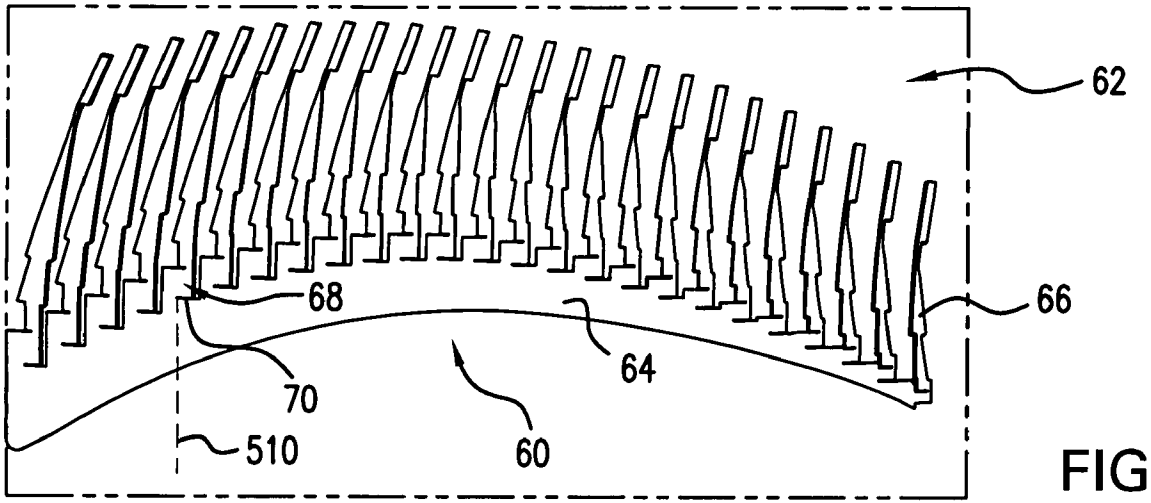
FIG. 5 is a plan view of a cut core precursor.
Figure 6:
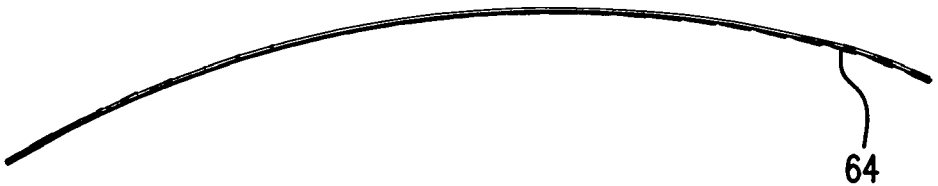
FIG. 6 is a leading end view of the precursor of FIG. 5 after a spine bending.
Figure 7:
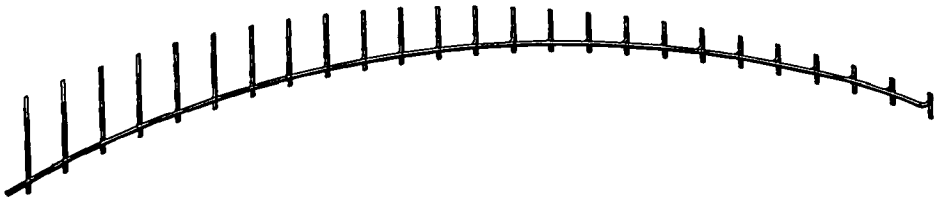
FIG. 7 is a view of the precursor of FIG. 6 after a tine bending.

Steps in the manufacture 200 of the core 20 are broadly identified in the flowchart of FIG. 4 and in the views of FIGS. 5-7. In a cutting operation 202 (e.g., laser cutting, liquid jet machining, or stamping), a cutting 60 (FIG. 5) is cut from a blank 62. The exemplary blank 62 is of a refractory metal-based sheet stock (e.g., molybdenum or niobium) having a thickness in the vicinity of 0.01-0.10 inch between parallel first and second faces and transverse dimensions much greater than that. The exemplary cutting 60 has a spine precursor 64 and an array of tine precursors 66. At junctions 68 between the spine precursor and tine precursors, there are partial undercuts 70 at tine roots and extending near parallel to the tine array. As is discussed in further detail below, the undercuts permit the tine precursors to be bent off-parallel to the spine precursor.

In a second step 204, the entire cutting is bent to provide the spine precursor with an arcuate shape (FIG. 6). Thereafter, the individual tine precursors are bent 206 relative to the spine precursor, each at an associated bend axis 510 (FIG. 5) adjacent a terminus of the undercut 70. The resulting core element shape is shown in FIG. 7 (see also FIG. 3).

The RMCs may be assembled 208 with their spines stacked atop each other and their tines interspersed. Thereafter, the spines may be secured 210 to each other such as by welding, brazing, diffusion bonding, or even use of fasteners or adhesive to form the RMC assembly 22. The assembly may be coated 212 with a protective coating. Alternatively a coating could be applied pre-assembly. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil thick. Layers of Pt, other noble metals, Cr, Si, W, and/or Al, or other non-metallic materials may be applied to the metallic core elements for oxidation protection in combination with a ceramic coating for protection from molten metal erosion and dissolution.

The RMC assembly 22 may be assembled in a die and the ceramic core 24 (e.g., silica-, zircon-, or alumina-based) molded thereover. An exemplary overmolding 214 includes molding the ceramic core 24 over the spine 30. The as-molded ceramic material may include a binder. The binder may function to maintain integrity of the molded ceramic material in an unfired green state. Exemplary binders are wax-based. After the overmolding 214, the preliminary core assembly may be debindered/fired 216 to harden the ceramic (e.g., by heating in an inert atmosphere or vacuum).

Figure 8:
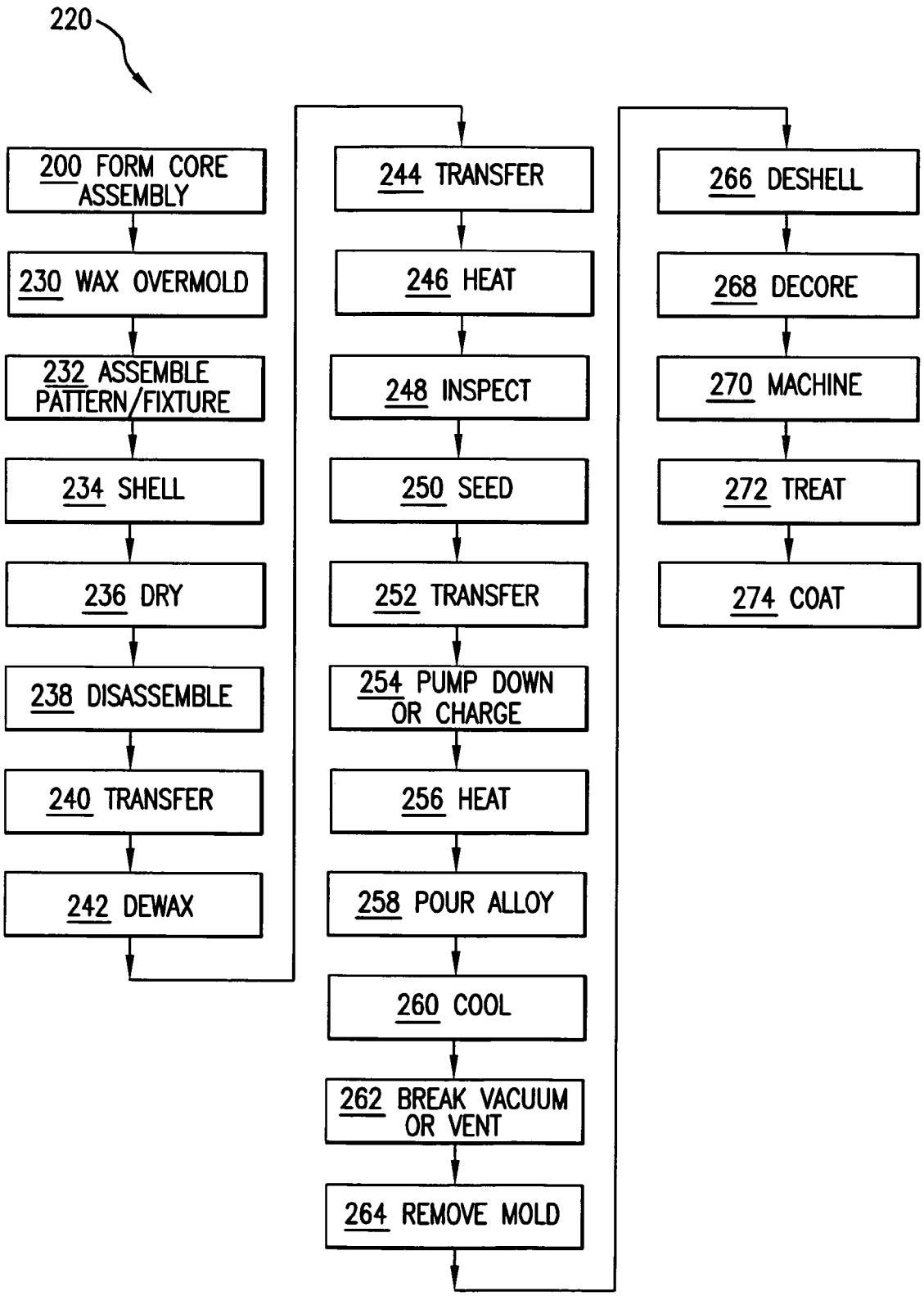
FIG. 8 is a flowchart of an investment casting method.

FIG. 8 shows an exemplary method 220 for investment casting using the composite core assembly. Other methods are possible, including a variety of prior art methods and yet-developed methods. The fired core assembly is then overmolded 230 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 232 to a shelling fixture (e.g., via wax welding between end plates of the fixture). The pattern may then be shelled 234 (e.g., via one or more stages of slurry dipping, slurry spraying, or the like). After the shell is built up, it may be dried 236. The drying provides the shell with at least sufficient strength or other physical integrity properties to permit subsequent processing. For example, the shell containing the invested core assembly may be disassembled 238 fully or partially from the shelling fixture and then transferred 240 to a dewaxer (e.g., a steam autoclave). In the dewaxer, a steam dewax process 242 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 244 to a furnace (e.g., containing air or other oxidizing atmosphere) in which it is heated 246 to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected 248. The mold may be seeded 250 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred 252 to a casting furnace (e.g., placed atop a chill plate in the furnace). The casting furnace may be pumped down to vacuum 254 or charged with a non-oxidizing atmosphere (e.g., inert gas) to prevent oxidation of the casting alloy. The casting furnace is heated 256 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 258 into the mold and the mold is allowed to cool to solidify 260 the alloy (e.g., after withdrawal from the furnace hot zone). After solidification, the vacuum may be broken 262 and the chilled mold removed 264 from the casting furnace. The shell may be removed in a deshelling process 266 (e.g., mechanical breaking of the shell).

The core assembly is removed in a decoring process 268 to leave a cast article (e.g., a metallic precursor of the ultimate part). The cast article may be machined 270, chemically and/or thermally treated 272 and coated 274 to form the ultimate part. Some or all of any machining or chemical or thermal treatment may be performed before the decoring.

Figure 9:
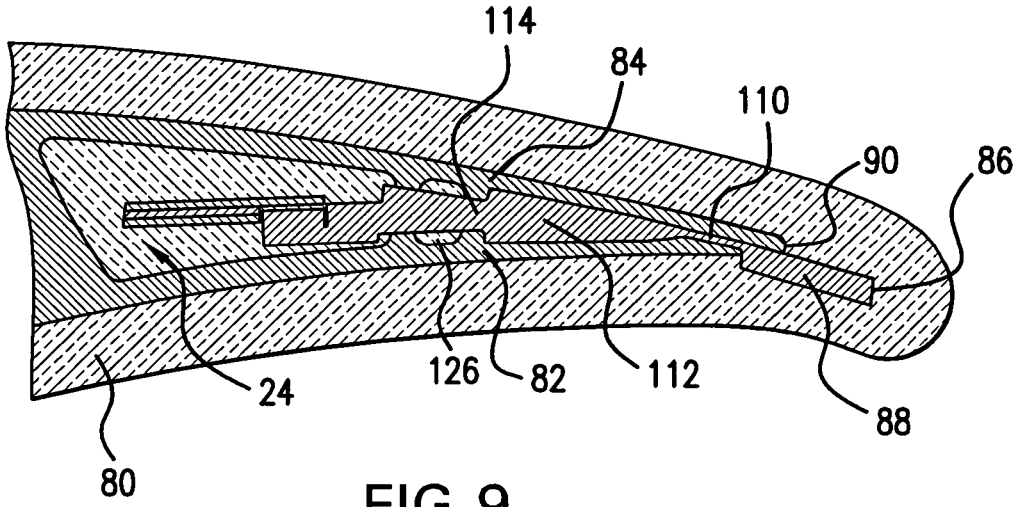
FIG. 9 is a partial streamwise sectional view of an airfoil being cast over the composite core of FIG. 1.
Figure 10:
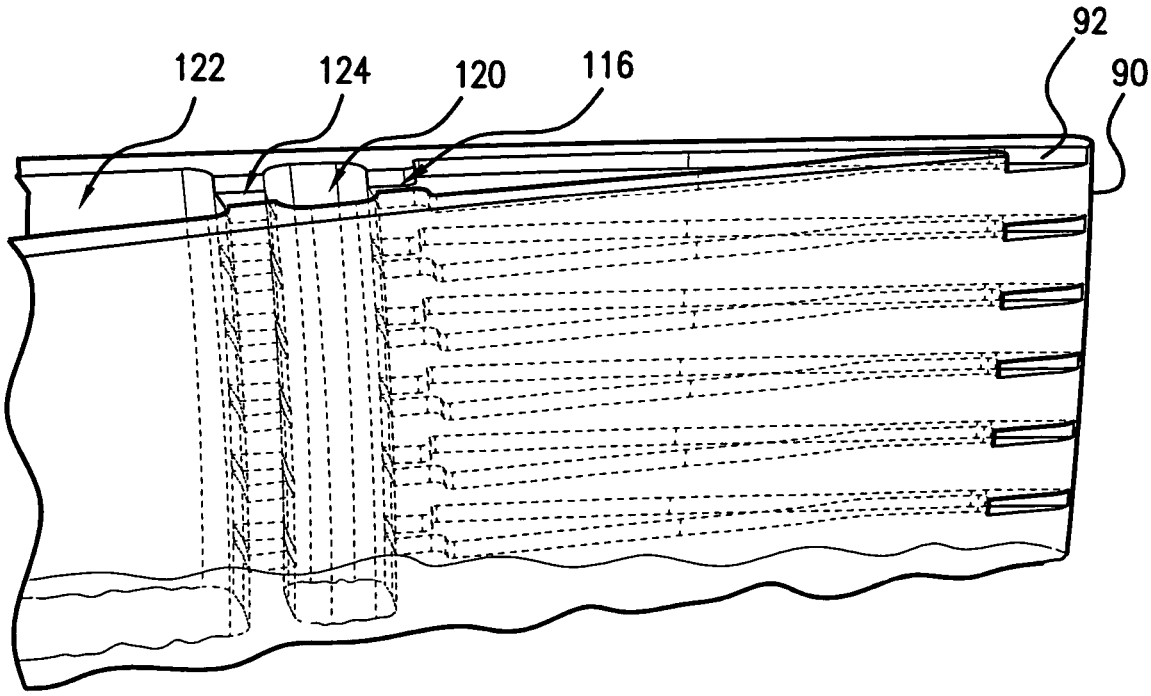
FIG. 10 is a partial cutaway view of the airfoil cast in FIG. 9.

FIG. 9 shows one of the tines along with an adjacent portion of the ceramic core 24 embedded in a shell 80. The shell contains cast alloy forming pressure and suction side wall portions 82 and 84 of the airfoil. The tine extends to a terminal end 86 embedded in the shell 80. A relatively large height terminal portion 88 protrudes along the pressure side to be embedded in the shell. Along the suction side, to a trailing edge 90 of the airfoil, the portion 88 is spaced apart from the shell to leave the suction side wall 84 intact. The protrusion of the portion 88 causes the portion 88 to form an outlet 92 along the pressure side (FIG. 10). Upstream of the portion 88, the tine has a relatively small cross-section (small height) portion 110. Forward/upstream thereof, the height may expand (from downstream to upstream) along a tapering portion 112. The exemplary tine has a slightly smaller height portion 114 separated from the portion 112 by shoulders along both pressure and suction sides. The exemplary portion 114 casts a relatively small cross-section portion 116 (FIG. 10) of the associated outlet passageway to serve a metering function. A rib 126 (FIG. 9) of the ceramic casts a plenum 120 (FIG. 10). The plenum 120 is connected to a feed passageway 122 by apertures 124 cast by proximal portions of the tines. The passageway 122 is formed by the main ceramic core portion into which the RMC assembly spine 30 is embedded.

Figure 11:
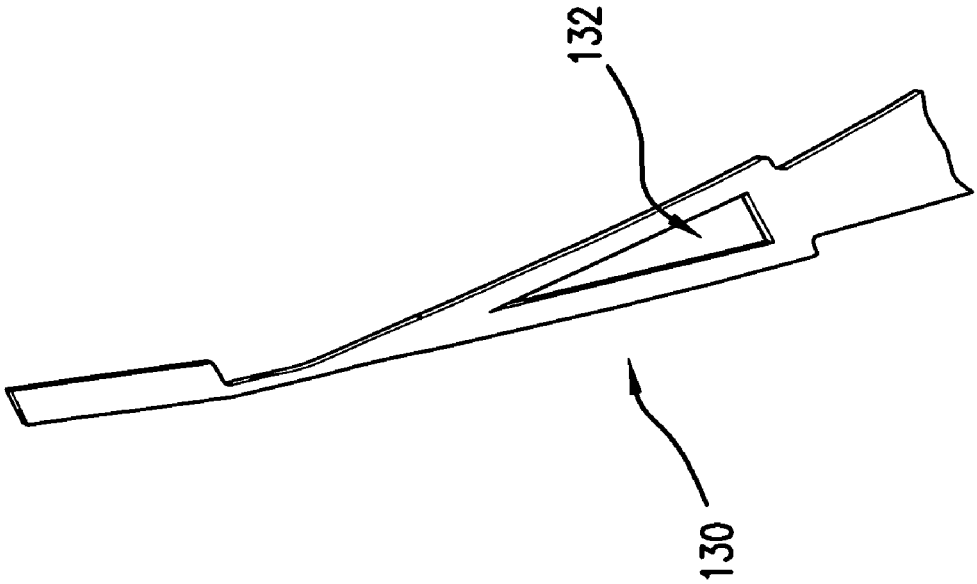
FIG. 11 is a side view of a first alternate refractory metal core tine.

Among variations, the cutting may provide the tines with a variety of enhancements. FIG. 11 shows a tine 130 otherwise similar to those described above but including a triangular through-aperture 132 within its tapering portion. As is discussed below, such through-apertures are effective to provide corresponding transverse posts or walls within the associated outlet passageway.

Figure 13:
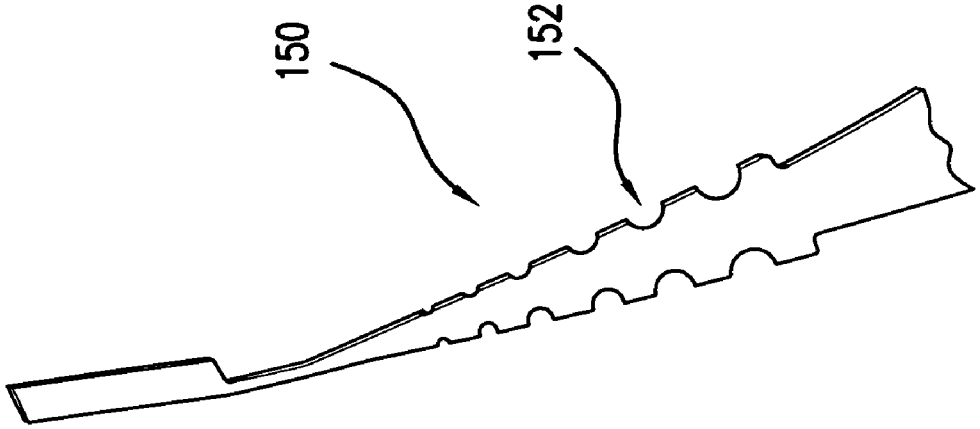
FIG. 13 is a side view of a third alternate refractory metal core tine.
Figure 12:
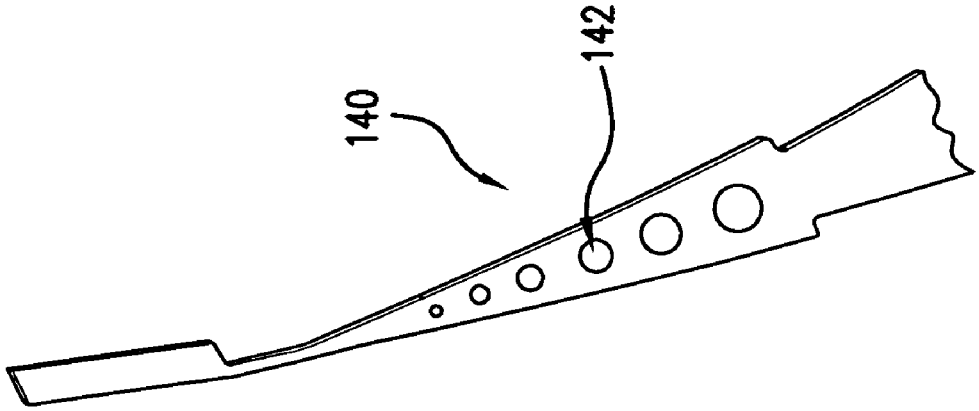
FIG. 12 is a side view of a second alternate refractory metal core tine.

FIG. 12 shows another similar tine 140 wherein the single triangular aperture 132 is replaced by an array of circular apertures 142 of progressively downstream decreasing diameter. FIG. 13 shows another similar tine 150 wherein the cutting provides edge recesses 152. The exemplary edge recesses are in opposed pairs from respective pressure and suction side edges of the tine. The edge recesses 152 provide a series of corresponding bumps in the pressure and suction sides of the outlet passageway. An alternative (not shown) would involve forming recesses (e.g., dimples) in the sides of the tines (the faces of the original core blank) rather than forming through-holes. The recesses would, in turn, cast protrusions from the spanwise sides of the outlet passageways.

Figure 15:
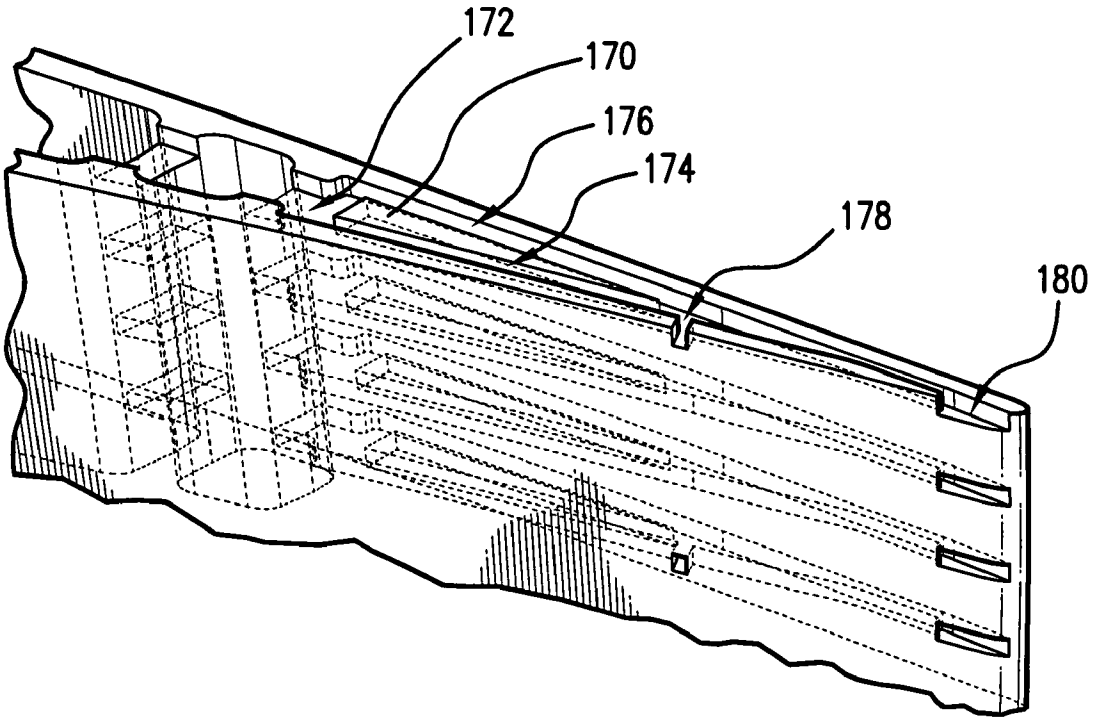
FIG. 15 is a partial cutaway view of an airfoil cast over the tine of FIG. 14.
Figure 14:
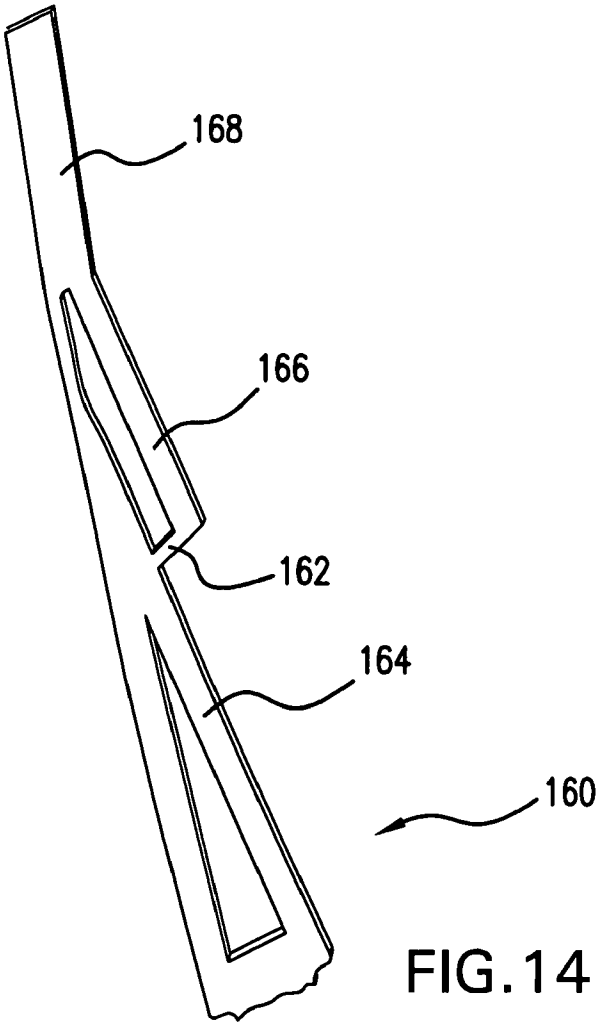
FIG. 14 is a side view of a fourth alternate refractory metal tine.

FIG. 14 shows a tine 160 which may be otherwise similar to the tine 130 of FIG. 11. However, as additional material, the tine 160 includes a pressure side projection 162 from the tapering portion 164. In the exemplary tine 160, the projection 162 is not a terminal projection but rather extends to a bracing portion 166 which extends downstream to the enlarged terminal portion 168. The exemplary portion 166 casts no internal feature but, instead, serves as a structural brace and further integrates the tine with the ultimate shell. FIG. 15 shows an airfoil cast with the tines 160. The aperture of the tapering portion casts a central transverse wall 170 dividing the outlet passageway 172 into pressure and suction side portions 174 and 176. The projection 162 casts an outlet hole 178 through the pressure side wall upstream of the associated trailing edge outlet 180.

Figure 16:
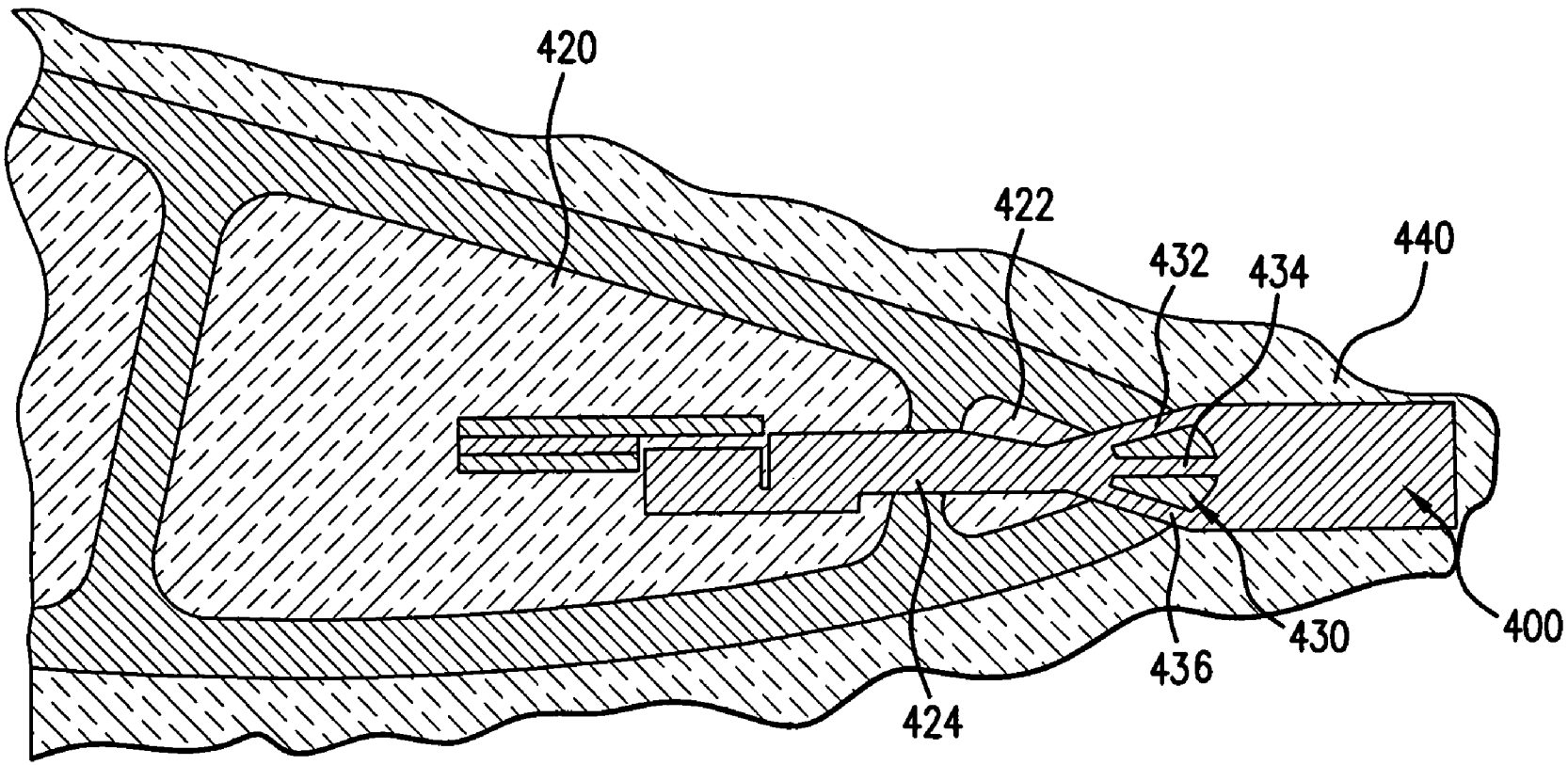
FIG. 16 is a partial streamwise sectional view of an airfoil being cast over an alternate composite core.
Figure 17:
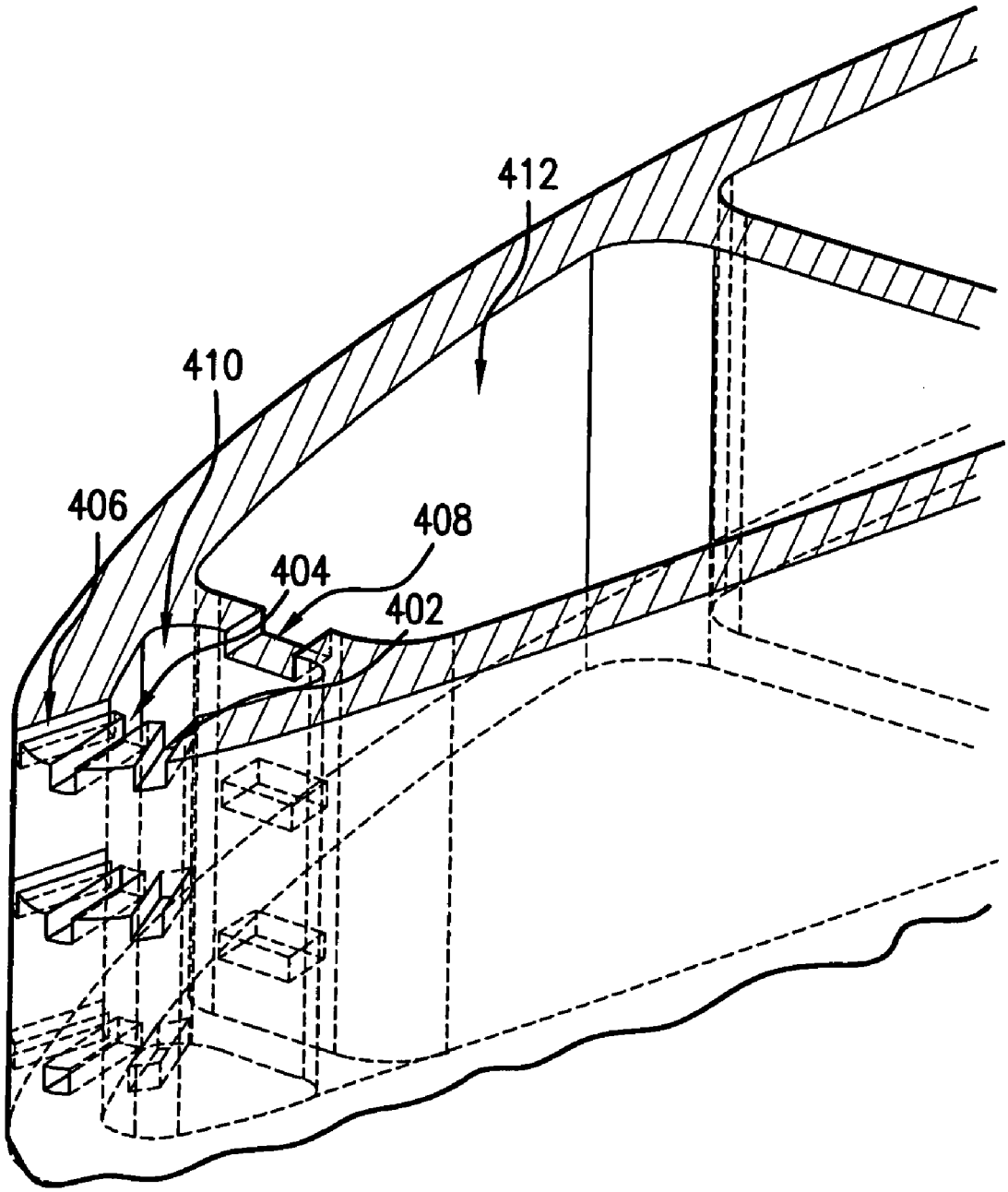
FIG. 17 is a partial cutaway view of the airfoil cast in FIG. 16.

FIG. 16 shows an exemplary tine 400 of a three-comb RMC assembly used to cast airfoil leading edge outlet holes 402, 404, and 406 (FIG. 17) and impingement cooling holes 408. The exemplary airfoil of FIG. 17 includes a leading edge impingement cavity 410. Immediately downstream thereof is a leading feed passageway 412 connected to the impingement cavity 410 by the impingement holes 408. In the exemplary airfoil, the holes 404 are very close to the exact airfoil leading edge, the holes 402 are shifted to the pressure side, and the holes 406 are shifted to the suction side.

The feed passageway 412 is cast by a branch 420 (FIG. 16) of a ceramic core which has been molded over the spine of the RMC assembly. A second rib-like portion 422 of the ceramic core casts the impingement cavity 410. A first relatively proximal portion 424 of each tine extends between the core portions 420 and 422 to cast an associated one of the impingement holes 408. A more distal portion is perforated with an exemplary pair of holes 430 to form branches 432, 434, and 436 which respectively cast the outlet holes 402, 404, and 406 in an associated group. A distal end portion of the tine is embedded in the shell 440.

Figure 19:
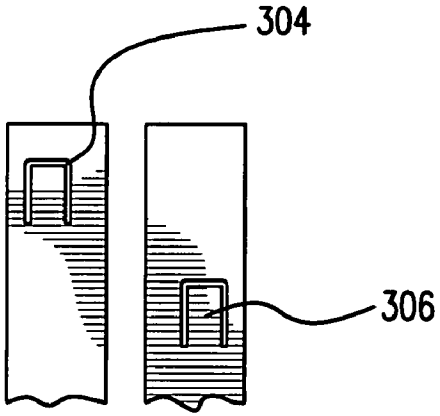
FIG. 19 is an enlarged view of tines of the precursor of FIG. 18.
Figure 21:
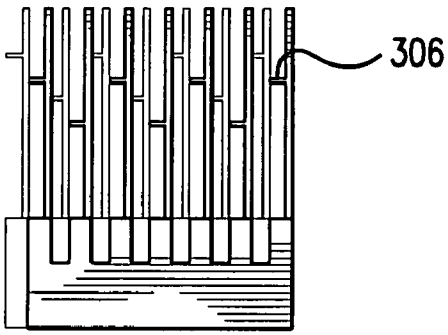
FIG. 21 is a view of an assembly of the core of FIG. 18 with a complementary core.
Figure 18:
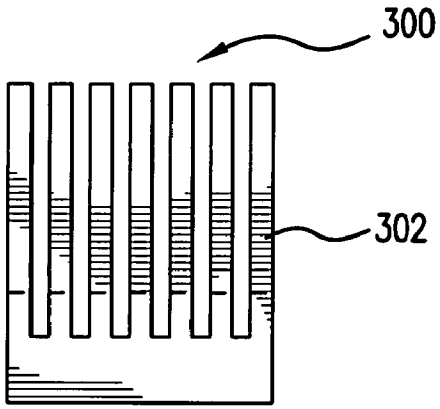
FIG. 18 is a simplified plan view of an alternate cut refractory metal core precursor.
Figure 20:
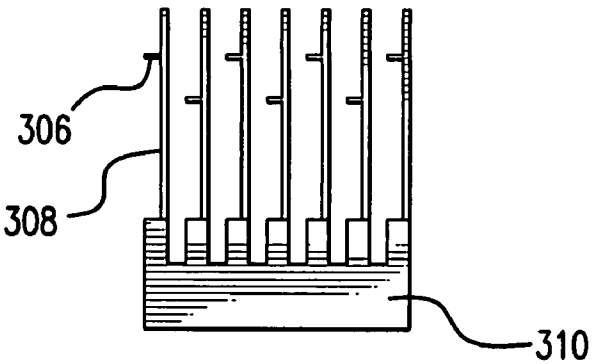
FIG. 20 is a view of the precursor of FIG. 18 after tine bending to form a core.

FIG. 18 shows a simplified cutting 300 wherein the tine precursors 302 include one or more U-shaped cuts 304 (FIG. 19) defining tabs 306. Whereas the main portions 308 of the tines may be bent transverse to the spine 310 (FIG. 20), the tabs 306 may be bent transverse to the main portions. When plural RMCs are stacked (two being shown assembled in FIG. 21), each of the tabs 306 may extend to and contact the main portion of the adjacent tine of the other core. The tabs may function to maintain tine position/spacing and may function to provide further flow spaces. Alternatives to such tabs might proved an interlocking beyond the illustrated abutting of tab to tine.

Figure 24:
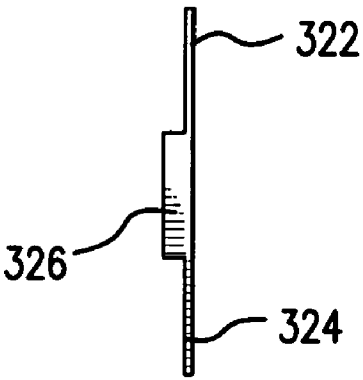
FIG. 24 is a side edge view of the precursor of FIG. 23.
Figure 23:
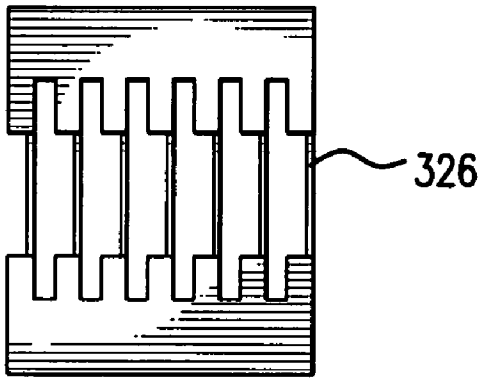
FIG. 23 is a view of the precursor of FIG. 22 after bending of linking portions.
Figure 22:
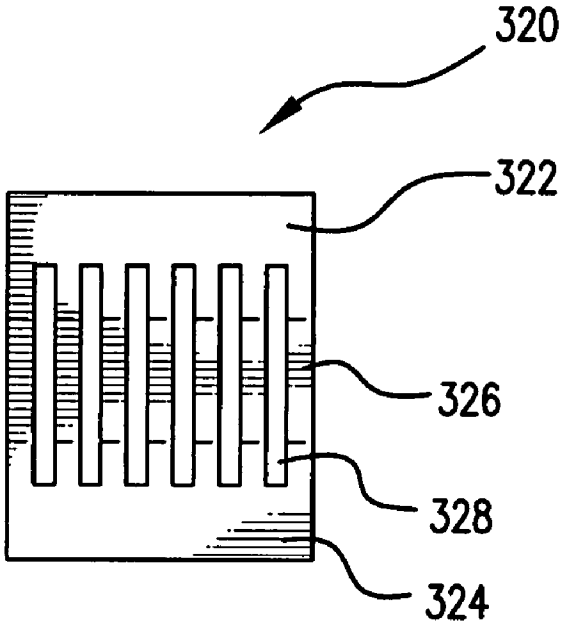
FIG. 22 is a simplified plan view of a second alternate cut core precursor.

FIG. 22 shows a simplified cutting 320 wherein, instead of having tines with terminal ends extending from a single spine, the cutting has a pair of spines 322 and 324 linked by discrete linking portions 326 separated by cutouts 328. The connection and relationship of the linking portions to each of the spines may be similar to those of the aforementioned tines to their associated spines. FIGS. 23 and 24 show the linking portions 326 after bending transverse to the spines.

Figure 25:
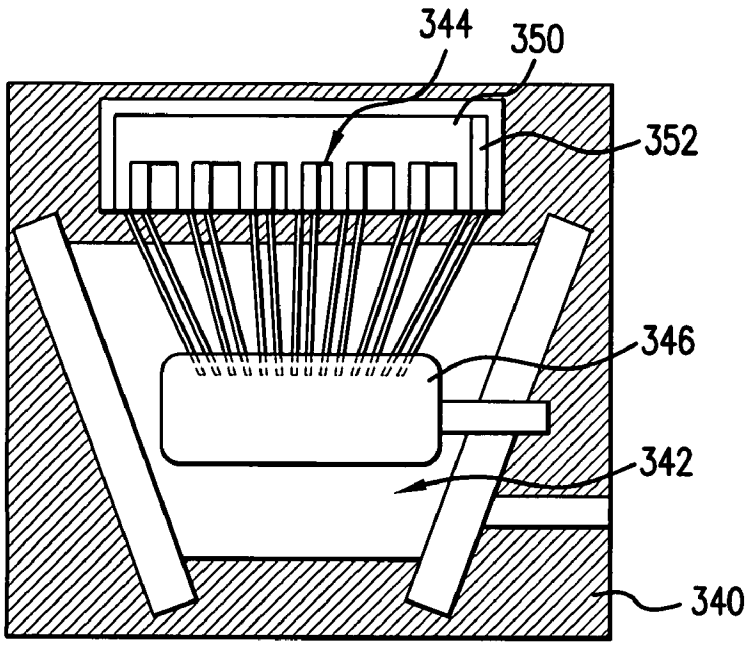
FIG. 25 is a schematic sectional view of a pattern-forming die.

FIG. 25 shows a pattern-molding die 340 having a cavity 342 for molding wax over an alternative composite core. The exemplary composite core includes an RMC assembly 344 and a ceramic core 346. General manufacturing considerations may be similar to any of those previously described or otherwise possible. In the exemplary situation, the RMC assembly spine 350 will reside outside the ultimate cast part (e.g., may become embedded in the casting shell). Tine free distal end portions lie within the ceramic core 346 (e.g., may be overmolded thereby). Thus, in the exemplary pattern-forming die 340, the RMC assembly spine 350 may be positioned within a separate compartment 352 that does not receive wax. For purposes of illustration, the exemplary compartment/cavity 342 is partially schematically shown for forming a vane structure, with the RMC tines positioned to form trailing edge outlet passageways.

Figure 27:
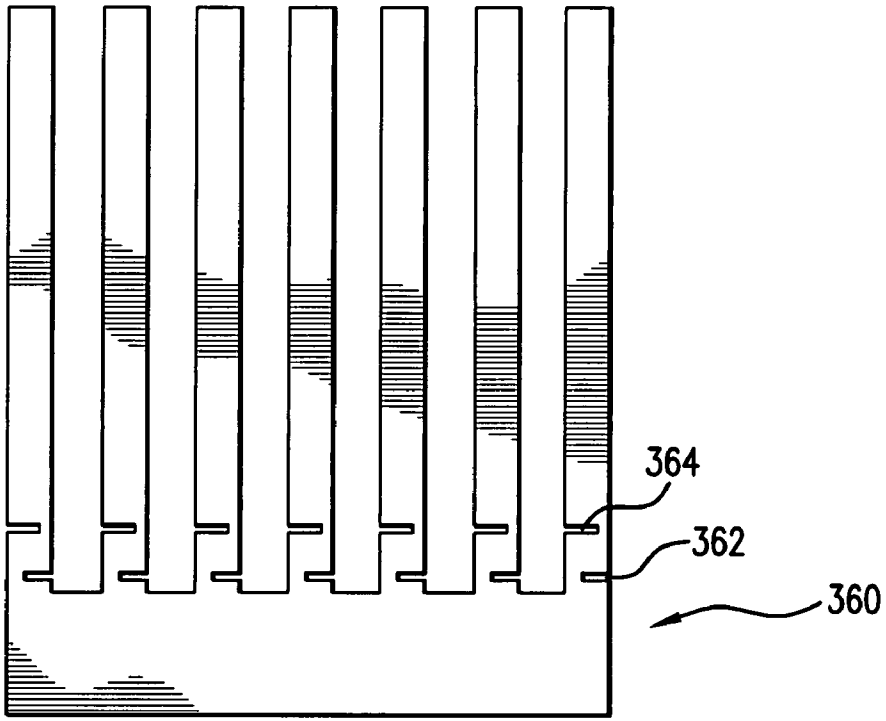
FIG. 27 is a view of a cut core precursor for an RMC of the assembly of FIG. 26.
Figure 33:
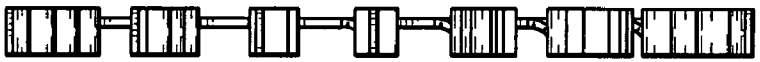
FIG. 33 is a front view of the RMC of FIG. 32.
Figure 32:
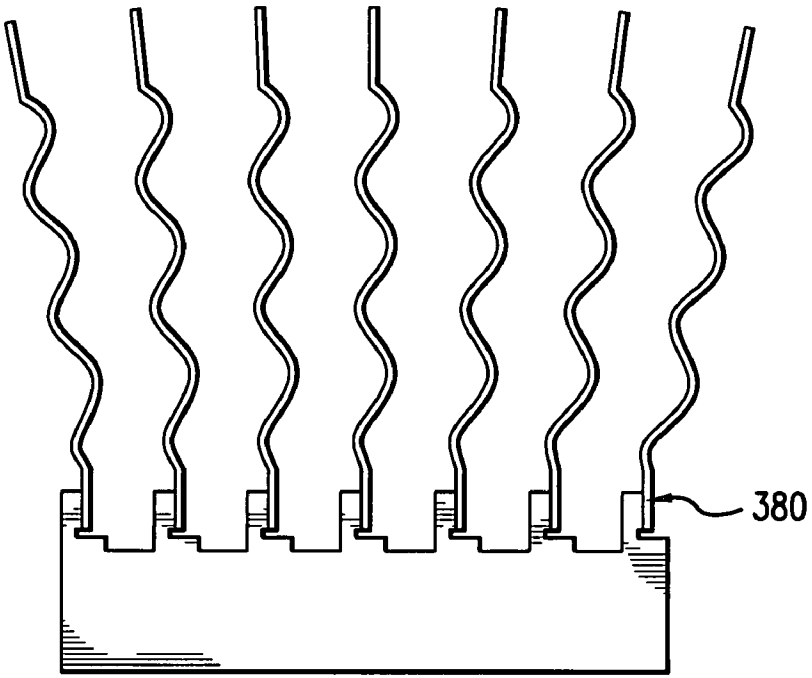
FIG. 32 is a view of an RMC of the assembly of FIG. 26 after a final tine bending.
Figure 26:
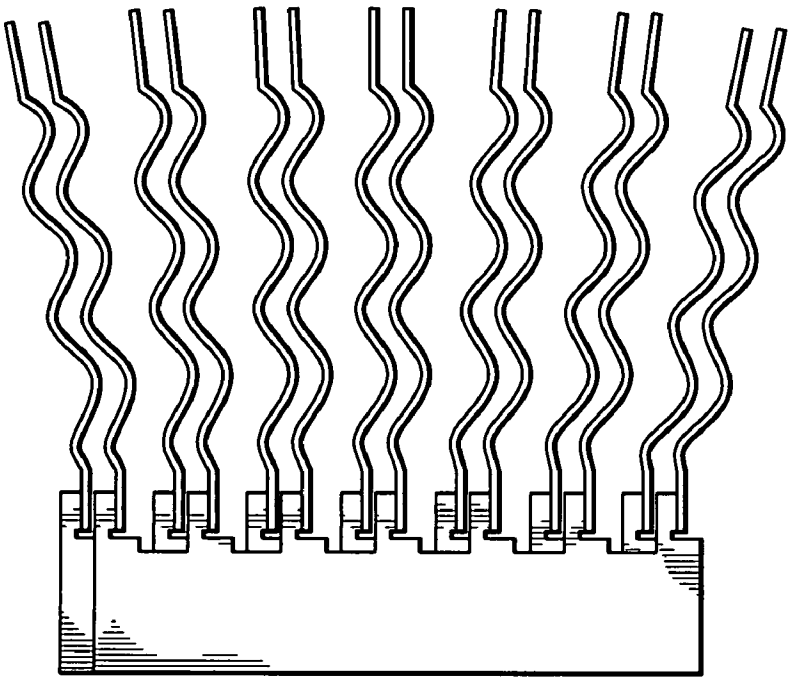
FIG. 26 is a view of an alternate RMC assembly.
Figure 30:
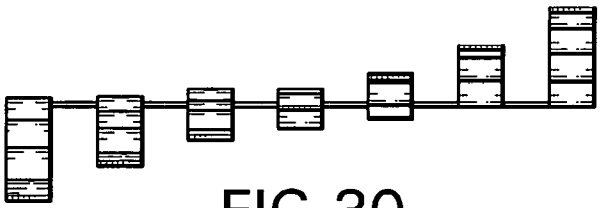
FIG. 30 is a front view of the precursor of FIG. 29.
Figure 31:
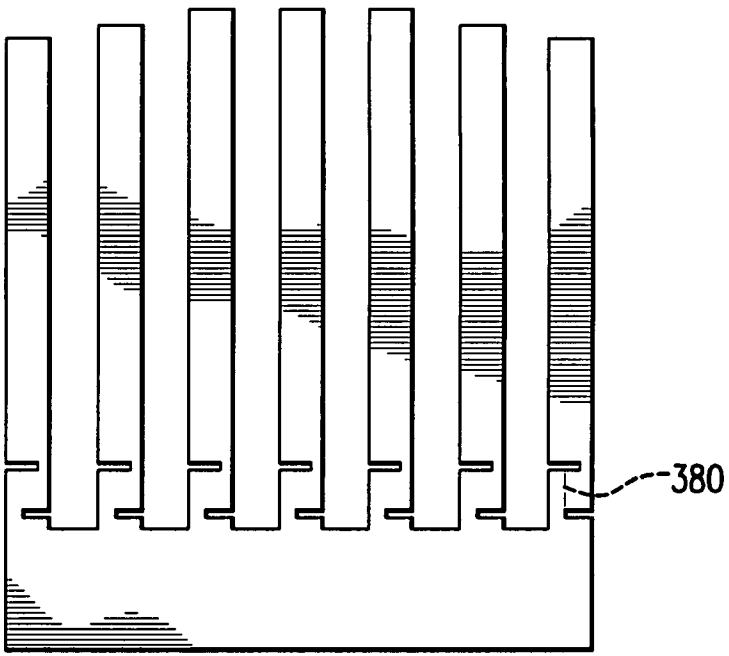
FIG. 31 is a plan view of the precursor of FIG. 29.
Figure 29:
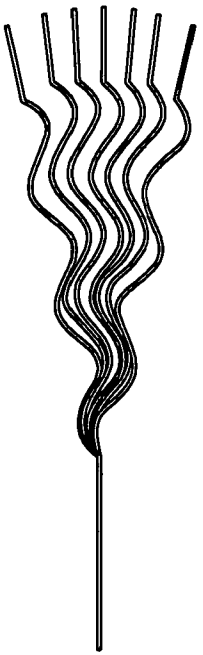
FIG. 29 is a side view of the precursor of FIG. 27 after a second shaping/forming step.
Figure 28:
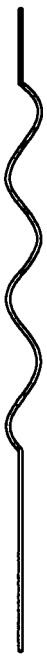
FIG. 28 is a side view of the precursor of FIG. 27 after a first forming/shaping step.

Other variations may involve bending the tines into convoluted form. FIG. 26 shows an assembly of two RMCs having tines bent in a wave-like form. FIG. 27 shows an initially-cut RMC precursor 360 for one of the RMCs of FIG. 26 oppositely directed. Each tine precursor is cut with a pair of proximal open-ended slots 362 and 364. In a first tine deforming stage of FIG. 28, the tines are bent (e.g., via a stamping or embossing) to impart a wave-like form. In a second stage of FIGS. 29-31, the tines are fanned by bending proximal tine portions about axes parallel to the spine. In a third stage of FIGS. 32 and 33, the tines are bent at folds 380 (FIGS. 31 and 32) connecting the slots 362 and 364 to produce a laterally fanned effect.

One or more embodiments of the present invention have been described. Nevertheless, it will be understood that various modifications may be made without departing from the spirit and scope of the invention. For example, the principles may be implemented using modifications of various existing or yet-developed processes, apparatus, or resulting cast article structures (e.g., in a reengineering of a baseline cast article to modify cooling passageway configuration). In any such implementation, details of the baseline process, apparatus, or article may influence details of the particular implementation. Accordingly, other embodiments are within the scope of the following claims.

What is claimed is:

1. A method for manufacturing a combination investment casting core, the method comprising:

forming a plurality of cores, each by:

cutting a metallic sheet to define:

a first portion; and a plurality of separate second portions linked by said first portion; and bending the second portions out of local alignment with the first portion;

assembling the first portions of plurality of cores; and securing the plurality of cores by the first portions.

2. The method of claim 1 wherein:

the cutting comprises at least one of laser cutting, liquid jet cutting, and stamping.

3. The method of claim 1 wherein:

the securing comprises at least one of welding, brazing, and diffusion bonding.

4. The method of claim 1 further comprising:

after the cutting and before the bending, bending the sheet from a planar to an arcuate form.

5. The method of claim 1 further comprising:

coating the secured plurality of cores.

6. The method of claim 1 further comprising at least one of:

overmolding a ceramic core to the secured plurality of cores; and assembling the secured plurality of cores to a pre-molded ceramic core.

7. The method of claim 1 wherein:

the bending comprises bending by at least 30° about a bend direction at least 30° off-parallel to a local direction of arraying of the second portions.

8. The method of claim 1 wherein:

the cutting forms apertures within the second portions.

9. The method of claim 1 wherein:

for at least a first of the cores:

the cutting forms the second portions with main portions and tab portions; and the bending bends said main portions out of said local alignment with the first portion and bends each tab portion out of local alignment with the associated main portion; and the assembling contacts each of the tab portions with an adjacent one of the second portions of a second of the cores.

10. The method of claim 1 wherein:

for at least a first of the cores, the cutting forms a third portion linking the second portions opposite from the first portion.

11. The method of claim 1 wherein:

for at least a first of the cores, the cutting forms the second portions with terminal ends opposite the first portion.

12. A method for investment casting comprising:

forming according to claim 1 an investment casting core;

molding a pattern-forming material at least partially over the at least one investment casting core for forming a pattern;

shelling the pattern;

removing the pattern-forming material from the shelled pattern for forming a shell;

introducing molten alloy to the shell; and removing the shell.

13. The method of claim 12 wherein said forming further comprises at least one of:

overmolding a ceramic core to the secured plurality of cores; and assembling the secured plurality of cores to a pre-molded ceramic core.

14. The method of claim 12 used to form a gas turbine engine component.

15. The method of claim 12 used to form a gas turbine engine airfoil wherein the second portions of said plurality of cores form trailing edge outlet passageways.

16. An investment casting core comprising:

a plurality of metallic casting core elements, each comprising:

a spine; and a plurality of branches extending from the spine and oriented out of locally parallel with the spine, the spines of said plurality of core elements secured to each other.

17. The investment casting core of claim 16 further comprising:

a ceramic core element engaging the combined spines of the plurality of metallic casting core elements.

18. The investment casting core of claim 17 wherein the branches are bent transverse to the spine about respective axes spaced apart from each other.

19. The investment casting core of claim 16 wherein the branches are bent transverse to the spine about respective axes spaced apart from each other.

20. The investment casting core of claim 16 wherein the plurality of metallic casting cores are formed of sheet metal.

21. The investment casting core of claim 16 wherein the plurality of branches of each of the metallic casting core elements are interspersed with the plurality of branches of the other metallic casting core elements.

22. The investment casting core of claim 21 wherein the plurality of branches of each of the metallic casting core elements have faces parallel to and spaced-apart from faces of the adjacent branches of the other metallic casting core elements.

* * * * *